US005372217A

United States Patent [19]

Hsu

[11] Patent Number: 5,372,217

[45] Date of Patent: Dec. 13, 1994

[54] EMERGENCY ESCAPE DEVICE

[76] Inventor: Chih-Hsiung Hsu, No. 67, Wen-Kai Rd., Lu-Kang Chen, Changhua Hsien, Taiwan, Prov. of China

[21] Appl. No.: 128,220

[22] Filed: Sep. 29, 1993

[51] Int. Cl.[5] ..... A62B 1/00

[52] U.S. Cl. ..... 182/70; 182/198; 182/160

[58] Field of Search ..... 182/70, 76, 93, 196, 182/197, 198, 156, 160

[56] References Cited

U.S. PATENT DOCUMENTS

| | | | |
|---|---|---|---|
| 266,183 | 10/1882 | Moore | 182/70 X |
| 4,189,030 | 2/1980 | Leslie et al. | 182/70 X |
| 4,298,092 | 11/1981 | Eriksson | 182/70 |
| 4,383,592 | 5/1983 | Hoffa | 182/70 |
| 4,445,589 | 5/1984 | Longenecker | 182/76 |
| 4,583,616 | 4/1986 | Baker | 182/70 X |
| 4,852,688 | 8/1989 | Strohmeyer, Sr. | 182/70 X |
| 5,018,600 | 5/1991 | Sobczak | 182/70 |

FOREIGN PATENT DOCUMENTS

| | | | |
|---|---|---|---|
| 2354888 | 5/1974 | Germany | 182/196 |

*Primary Examiner*—Karen J. Chotkowski

*Attorney, Agent, or Firm*—Cushman, Darby & Cushman

[57] ABSTRACT

An emergency escape device includes a rectangular carrier in which a rope-ladder is stored. The carrier includes upper and lower horizontal beams, and two vertical side beams interconnecting the upper and lower horizontal beam. Each of the vertical side beams has a retaining member to retain spacers that are fixed to two ends of the rungs which, in turn, interconnect two parallel cables so as to define the rope-ladder.

7 Claims, 9 Drawing Sheets

EMERGENCY ESCAPE DEVICE

BACKGROUND OF THE INVENTION

1. Field of the Invention

The invention relates to an emergency escape device, more particularly to an emergency escape device which has a rope-ladder stored therein and which can be easily converted into an operable state from the stored state when desired.

2. Description of the Related Art

For urban dwellers, especially those residing in tall buildings, there is always the danger of fire. Some of these tall buildings are not equipped with an emergency escape device to permit the escape of occupants of the building in case of a fire. As a precautionary measure, the electric power to operate the lifts in tall buildings is cut off to prevent the fire from escalating, thus rendering the lift useless. People living in upper storeys may encounter trouble when escaping by means of the stairways if the latter is filled with smoke due to the fire. These people may suffocate to death when escaping by means of the stairways.

SUMMARY OF THE INVENTION

A main objective of the present invention is to provide an emergency escape device which has a rope-ladder carrier and a rope-ladder that is stored detachably therein and that can be thrown downwardly from an upper storey for escaping purposes.

A second objective of the present invention is to provide an emergency escape device which can be fixed securely to a window frame so as to form an additional protection for the window.

A third objective of the present invention is to provide an emergency device which is portable so that it can be carried easily and can be detachably fixed to a desired place when in use.

A fourth objective of the present invention is to provide an emergency device which is simple in construction and which can be easily and economically produced.

Accordingly, an escape device of the present invention includes a rope-ladder carrier and a rope-ladder which is detachably stored and retained in the rope-ladder carrier. The rope-ladder includes a pair of cables and a plurality of rungs each connected securely and transversely to the parallel cables to form the rope-ladder. Each of the rungs has two spacers provided at two ends thereof. The rope-ladder carrier includes an upper horizontal beam, a lower horizontal beam spaced from the upper horizontal beam and two vertical side beams connected to the upper and lower horizontal beams to define the carrier. Each of the vertical side beams has a vertically extending retaining member to retain the spacers in a stack arrangement with each of the rungs extending transversely between the vertical side beams and being parallel to the upper and lower horizontal beams when the rope-ladder is stored in the carrier.

In one preferred embodiment, the rope-ladder carrier is provided with a handle so that it can be carried to a desired place. Each of the vertical side beams has front and rear longitudinal sides. The retaining members in this embodiment are two L-shaped flange members which are respectively and securely connected to the front and rear longitudinal sides and which extend inwardly of the carrier. The lower horizontal beam is connected securely to two ends of the vertical side beams. A first end of the upper horizontal beam is hinged to opposite end of one of the vertical side beams, while a second end of the upper horizontal beam is fastened releasably to an opposite end of another vertical side beams so the upper horizontal beam can be rotated about the hinged end to open the top side of the rope-ladder carrier to removal of the rope-ladder therefrom for fixing to a window or a door frame when in use.

In another preferred embodiment, the rope-ladder carrier can be fixed to an exterior of a window frame, wherein the transversely extending rungs of the rope-ladder cooperatively form an obstruction, thus forming an additional protection for the window. The rope-ladder carrier includes upper and lower horizontal beams and two vertical side beams which cooperatively define the rope-ladder carrier. Each of the vertical side beams includes a vertical main member fixed securely to the horizontal beams. Each of the vertical main member has front and rear longitudinal sides, a first vertical groove which is formed at the front longitudinal side and a first elongated L-shaped flange which extends from the rear longitudinal side. The escape device further includes a guide frame for guiding the rope-ladder when the rope-ladder is in use. The guide frame is connected foldably to the carrier and can be folded over the carrier when the ladder is stored and retained in the carrier. The guide frame includes a first transverse member 110 hinged to the lower horizontal beam, a second transverse member to be fastened releasably to the upper horizontal beam when the guide frame is folded, and two vertical side members which are respectively connected to the first and second transverse members. Each of the vertical side members has a vertical insert and a second elongated L-shaped flange integrally formed with the vertical insert to define a vertical second groove therebetween. The vertical insert fits releasably within the vertical first groove of the vertical main member while the second elongated L-shaped flange of the vertical side frame is located opposite to the first L-shaped frame, thereby constituting a vertical space. A longitudinal slit is formed between the first and second L-shaped flanges. When the guide frame is folded to the carrier, the first and second L-shaped flanges cooperatively define a retaining member to retain and store the rope-ladder in the carrier with the spacer being stacked over one another. When the guide frame is at an unfolded position relative to the carrier, the rope-ladder is exposed from the carrier and the spacers of the rungs in the rope-ladder are guided downward by the second vertical groove of the vertical side frame so as to permit the rope-ladder to hang from the carrier. The rope-ladder extends downward from the carrier and is spaced slightly apart from a building wall on which the device is fixed to facilitate an escapee's decent in case of fire.

BRIEF DESCRIPTION OF THE DRAWINGS

Other features and advantages of the present invention will become more apparent in the following detailed description of the preferred embodiments with reference to the accompanying drawings, in which.

DETAILED DESCRIPTION OF THE PREFERRED EMBODIMENTS

Figure 1:
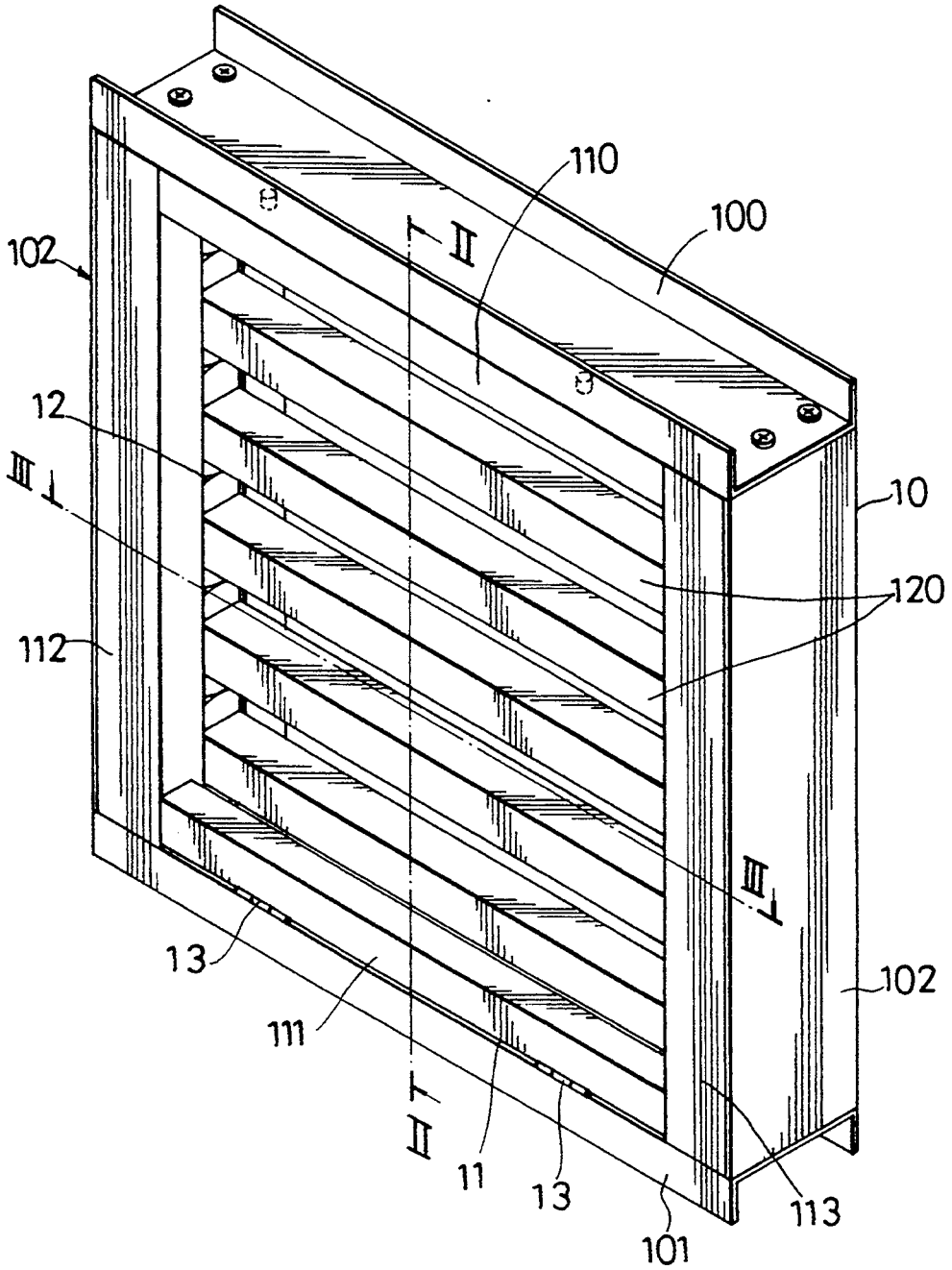
FIG. 1 is a perspective, schematic view of a first preferred embodiment of an emergency escape device he present invention.
Figure 2:
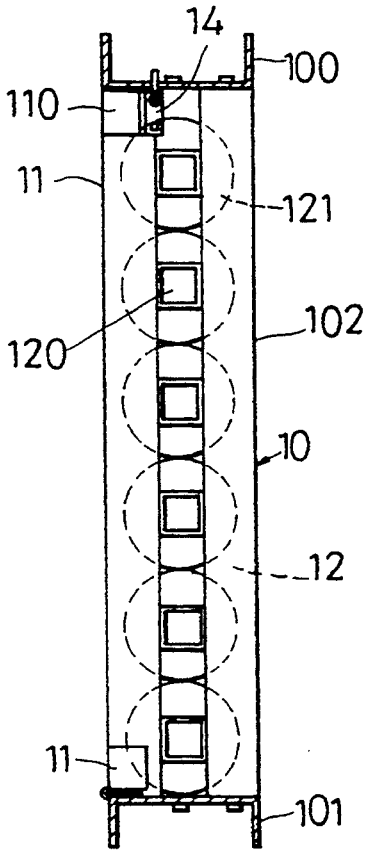
FIG. 2 shows a cross sectional view of the emergency escape device of the present invention taken along line II—II in FIG. 1.
Figure 3:
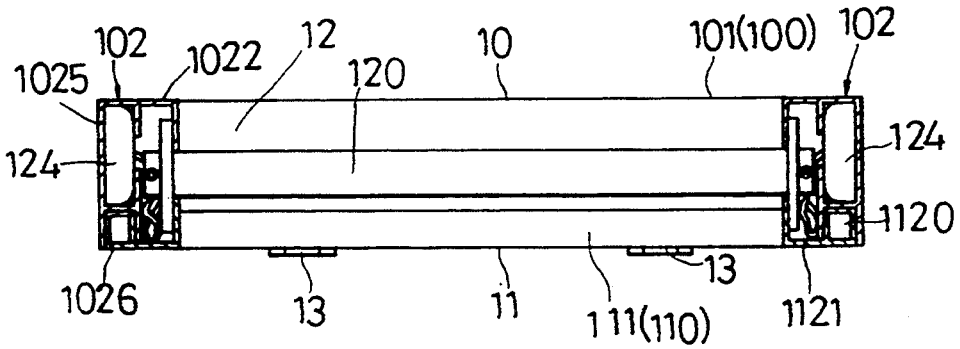
FIG. 3 shows a cross sectional view of the emergency escape device of the present invention taken along III—III in FIG. 1.

Referring to FIGS. 1 to 3, a first preferred embodiment of an emergency escape device of the present invention is shown to comprise a rope-ladder 12 and a rope-ladder carrier 10 for retaining and storing the rope-ladder 12 therein. The carrier 10 includes an upper horizontal beam 100, a lower horizontal beam 101 spaced from the upper horizontal beam 100, and two vertical side beams 102 connected to the upper and lower horizontal beams 100, 101 to define the carrier 10. Each of the upper and lower horizontal beams 100, 101 is U-shaped in cross section.

Figure 4:
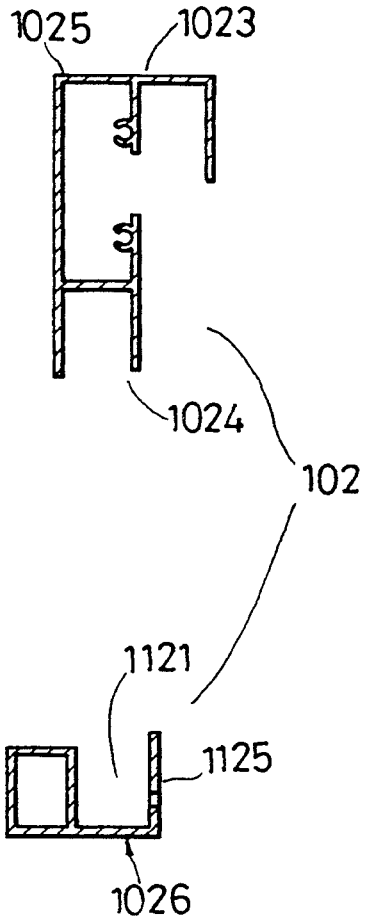
FIG. 4 shows a cross sectional top view of a vertical side beam the emergency escape device of the present invention.

Referring to FIG. 4, each of the vertical side beams 102 includes a vertical main member 1025 that has two ends fixed to the upper and lower horizontal beams 100, 101, a front longitudinal side 1024, a rear longitudinal side 1023, a first vertical groove 1021 formed at the front longitudinal side 1024, a first L-shaped flange 1022 which is formed at the rear longitudinal side 1023 and which extends inwardly of the carrier 10, and a vertical engaging groove 1020 which faces an interior of the carrier 10.

Figure 5:
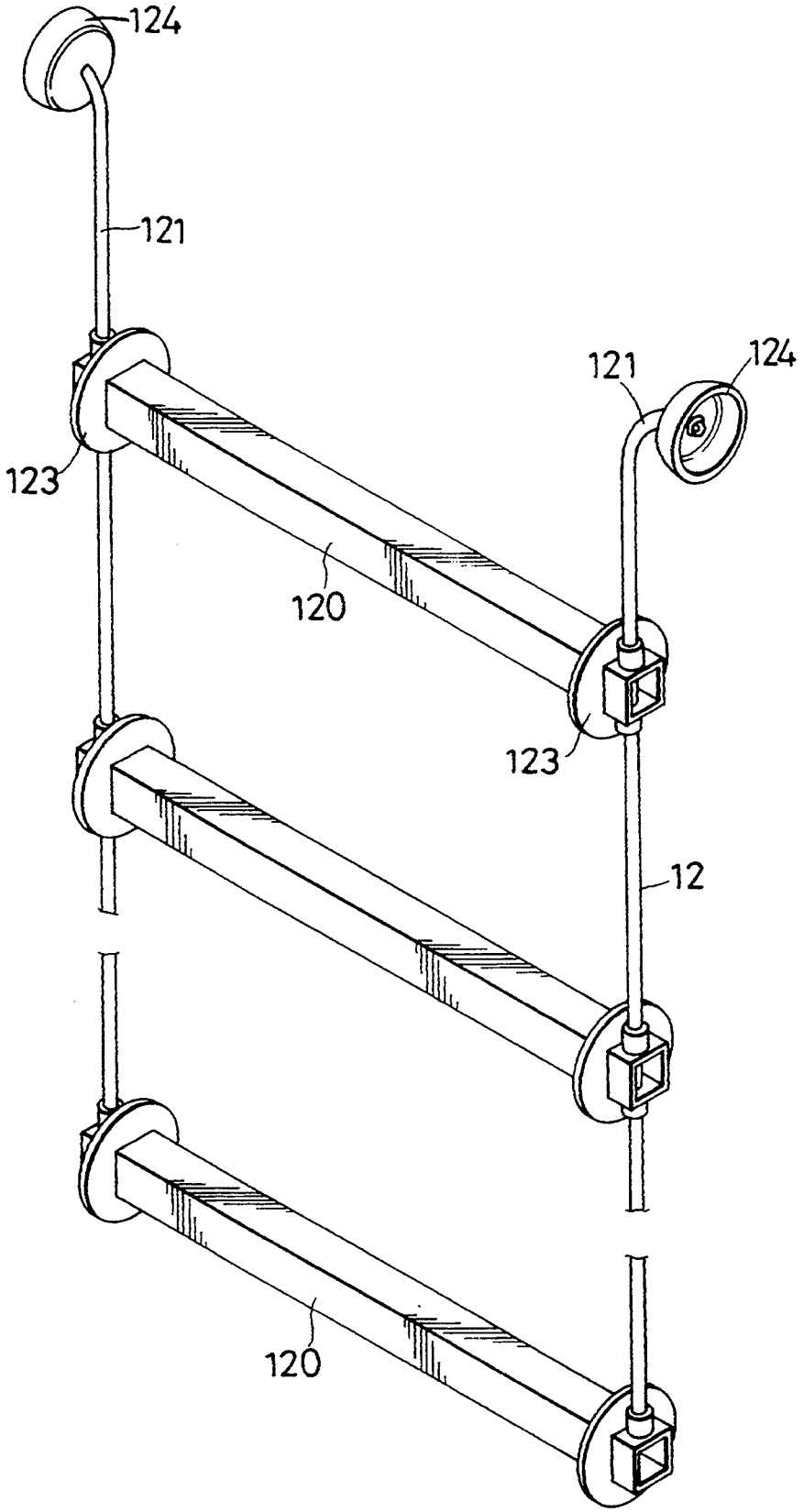
FIG. 5 illustrates an enlarged view of a rope-ladder of the emergency escape device of the present invention.

Referring to FIG. 5, the rope-ladder 12 includes a pair of parallel cables 121 which have two ends that are provided with engaging pieces 124, and a plurality of rungs 120 connected securely to the parallel cable 121 to form the rope-ladder 12. Each of the rungs 120 has two spacers 123 fixed securely to two ends thereof, the purpose of which will be described in detail in the succeeding paragraphs.

Figure 6:
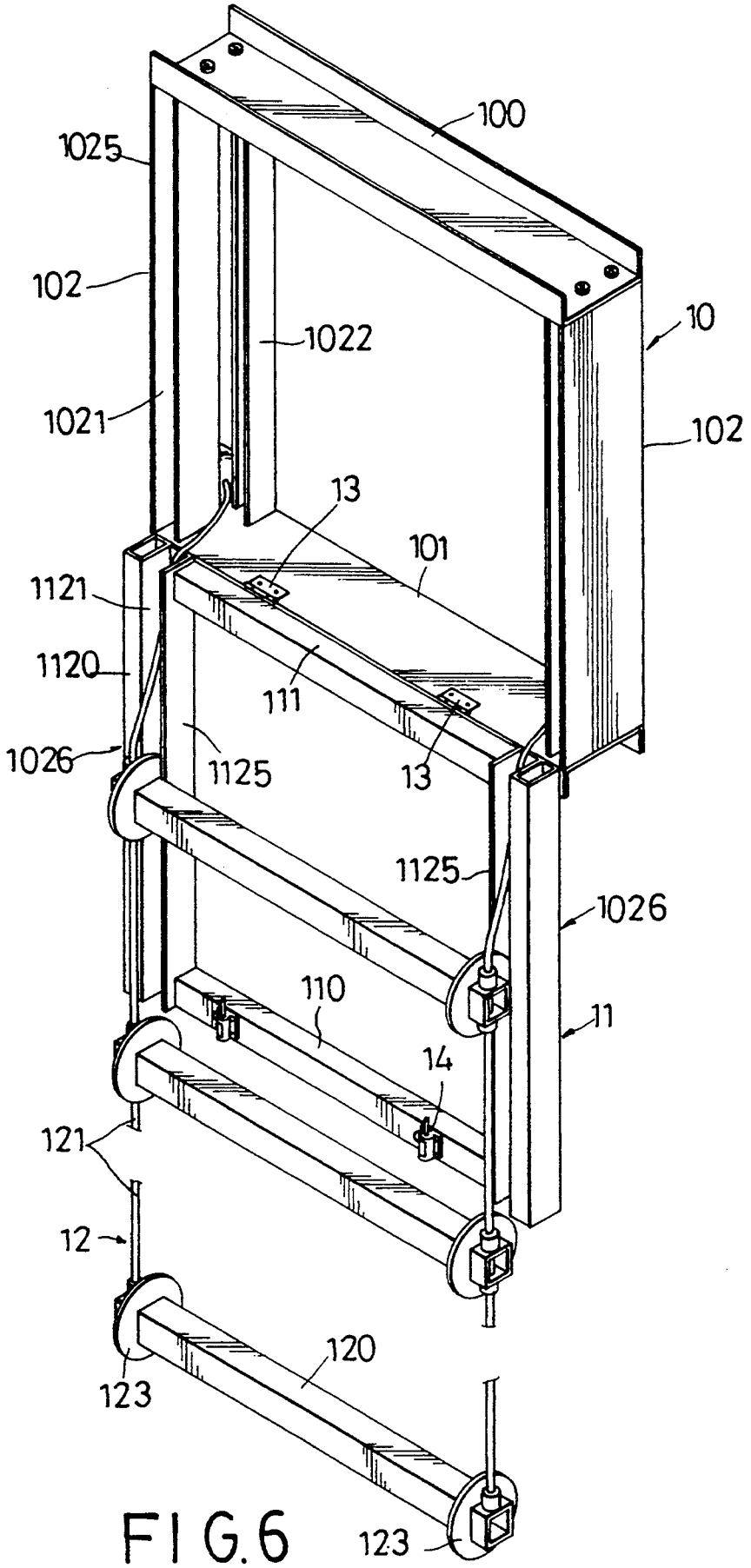
FIG. 6 illustrates the first preferred embodiment of the emergency escape device of the present invention when in use.
Figure 7:
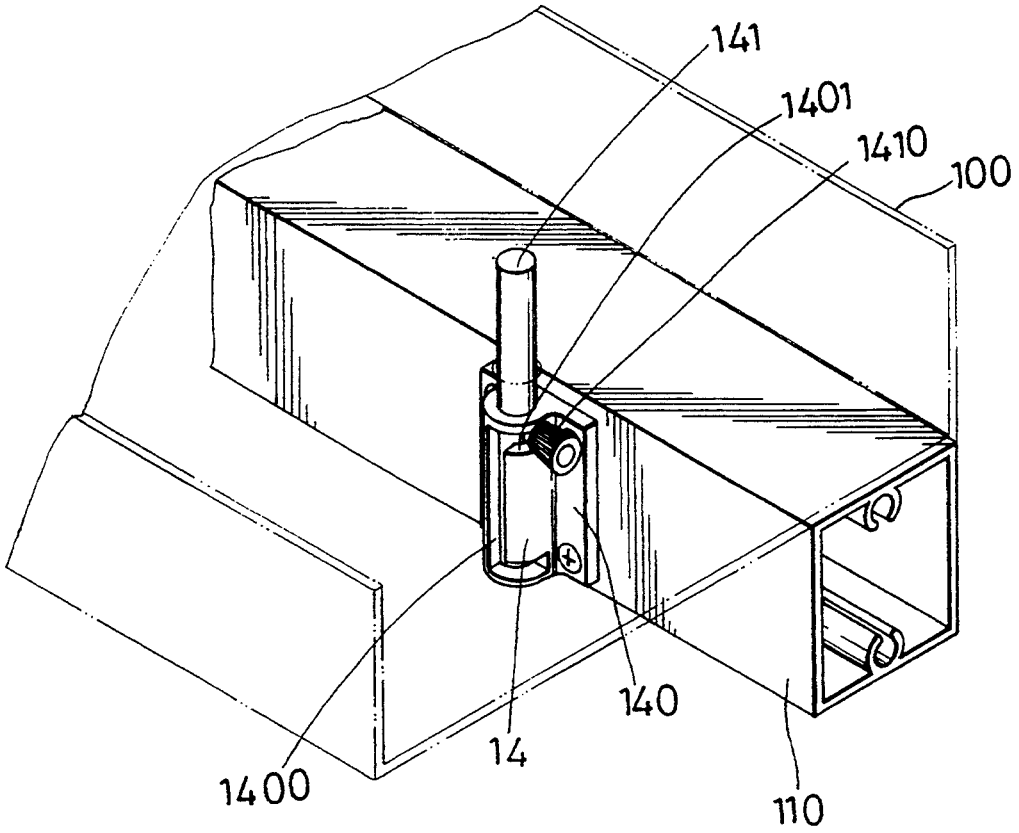
FIG. 7 shows the first preferred embodiment of the emergency escape device of the present invention when in a stored position, the lower portion thereof being left out for illustrative purposes.

Referring to FIGS. 6 and 7, the escape device further includes a guide frame 11 which is connected foldably to the carrier 10 so as to be folded over the latter. The guide frame 11 includes a first transverse member 110 hinged to the lower horizontal beam 101, a second transverse member 111 which can be fastened releasably to the upper horizontal beam 100 by means of a fastener 14, such as a latch and two vertical side frames 1026. The fastener 14 includes a fastener seat 140 fixed to the second transverse member 110 and formed with a slide path 1400 and, an engaging recess 1401 at an upper end of the slide path 1400 and a locking bolt 141 with an engaging stud 1410 that slides along the slide path 1400 and that engages the engaging recess 1401 after the locking bolt 141 is received by a receiving hole (not shown) formed in the upper horizontal beam 100. The vertical side frames 1026 are connected securely to the first and second transverse guide frames 110, 111 to define the guide frame 11 so that the guide frame 11 can be folded over the carrier 10 to retain the rope-ladder 12 in cooperation with the first L-shaped flange member 1022. The guided frame 11 can be unfolded relative to the carrier 10 for guiding the rope-ladder 12 when the rope-ladder is in use. Each of the vertical side frames 1026 has a vertical insert 1120 and a second L-shaped flange 1125 that is formed integrally with the vertical insert 1120 to define a second vertical groove 1121, the relative positions of which with respect the carrier 10 will be described in greater detail in the following paragraphs.

The engaging pieces 124 of the rope-ladder 12 engage the vertical engaging groove 1020 of the vertical main member 1025 when the rope ladder 12 is disposed in the carrier 10. When the guide frame 11 is folded and fastened to the upper horizontal beams 100 by means of the fastener 14, the vertical insert 1120 fits in the first vertical groove 1021 of the vertical main member 1025 while the second L-shaped flange 1125 is located opposite to the first L-shaped flange 1022 of the main member 1025, thereby constituting a vertical space to receive the spacers 123 in a stacked arrangement. A longitudinal slit is formed between the first and second L-shaped flanges 1022, 1125. The first and second L-shaped flanges 1022, 1125 cooperatively form a retaining member to retain the rope-ladder 12 therein such that the rungs 120 extend through the longitudinal slit confined by the L-shaped flanges 1022, 1125 and are disposed transversely between the vertical side frames 1026.

Figure 8:
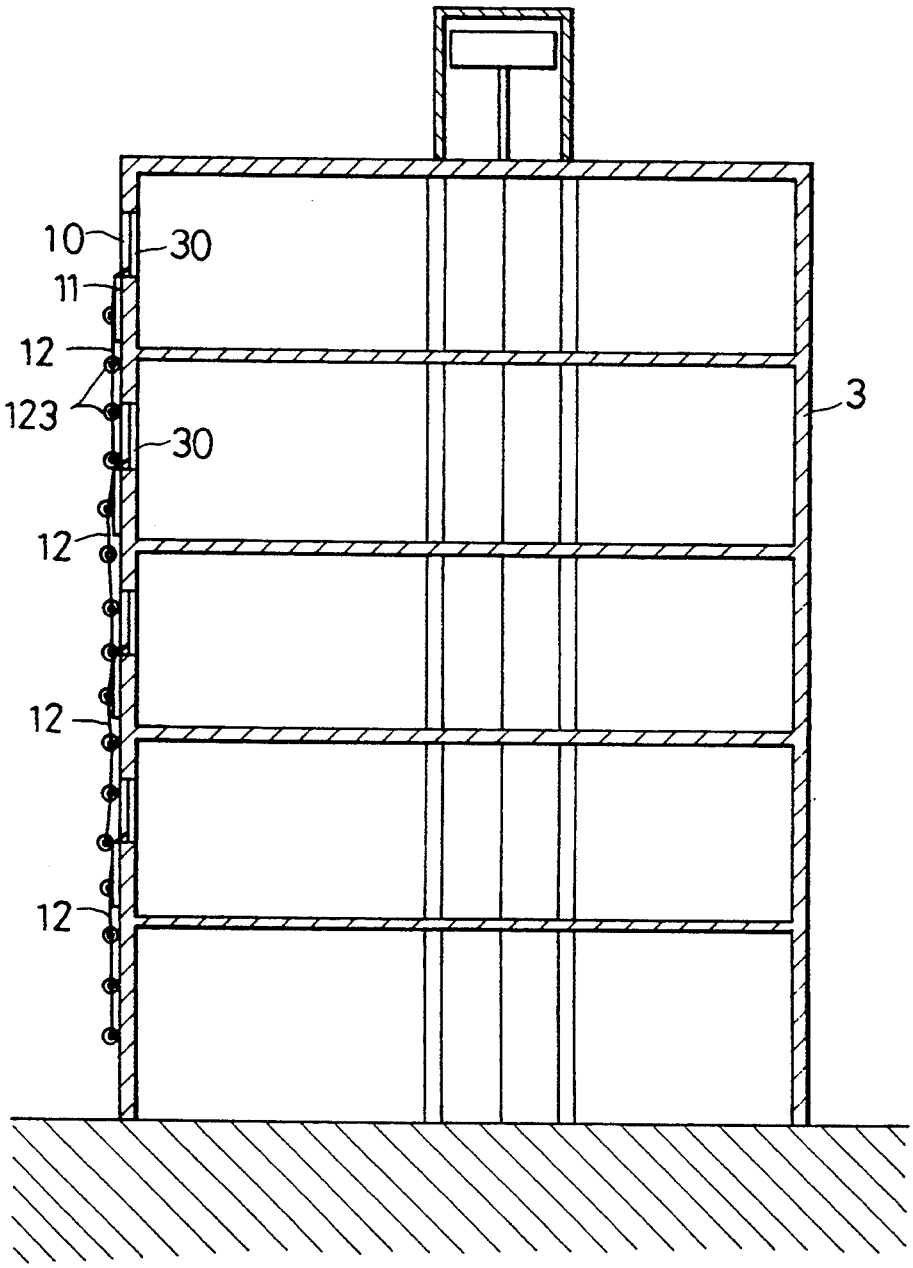
FIG. 8 illustrates the first preferred embodiment of the emergency escape device of the present invention when fixed to a window frame.

Since the carrier 10 is generally fixed to a window frame (not shown), the rungs 120 of the rope-ladder 12 cooperatively form an obstruction for an intruder when the guide frame 11 is at the folded state. Thus, the escape device provides an additional protection to the window aside from its main task. When the guide frame 11 is unfolded relative to the carrier 10, as shown in FIG. 6, the rope-ladder 12 is exposed and extends downward from the carrier 10 so that a portion of the spacers 123 of the rungs 120 are guided by the second vertical groove 1121 of the vertical side frames 1026. The guide frame 11 is sized so as to fit snugly within the carrier 10 when in the folded state. Remaining portions of the spacers 123 abut against a building wall to which the carrier 10 is fixed, as shown in FIG. 8 thereby facilitating gripping of the rope-ladder and stepping on the rungs 123 when descending in case of a fire.

Figure 9:
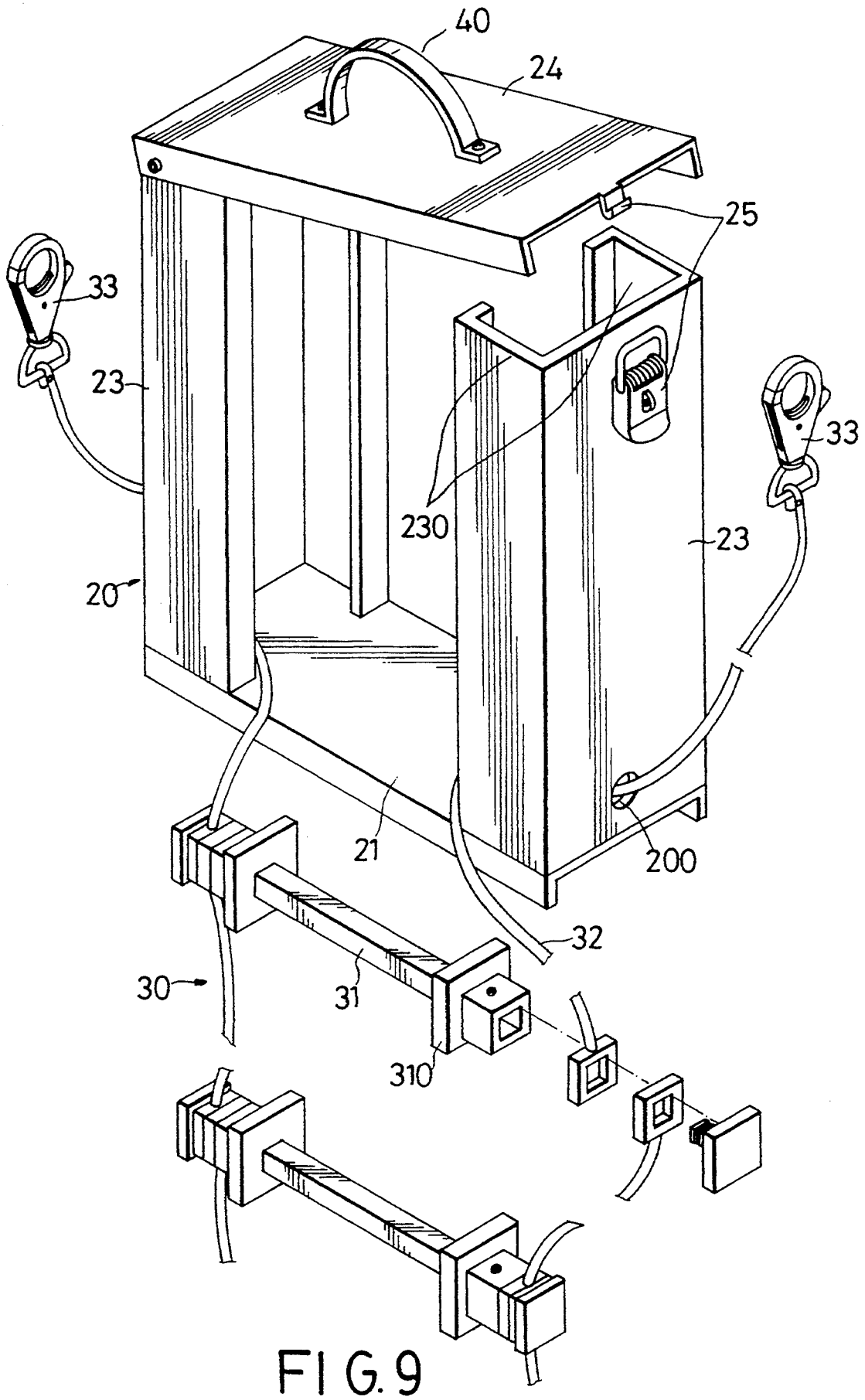
FIG. 9 shows a partially exploded view of a second preferred embodiment of the emergency escape device of the present invention.
Figure 10:
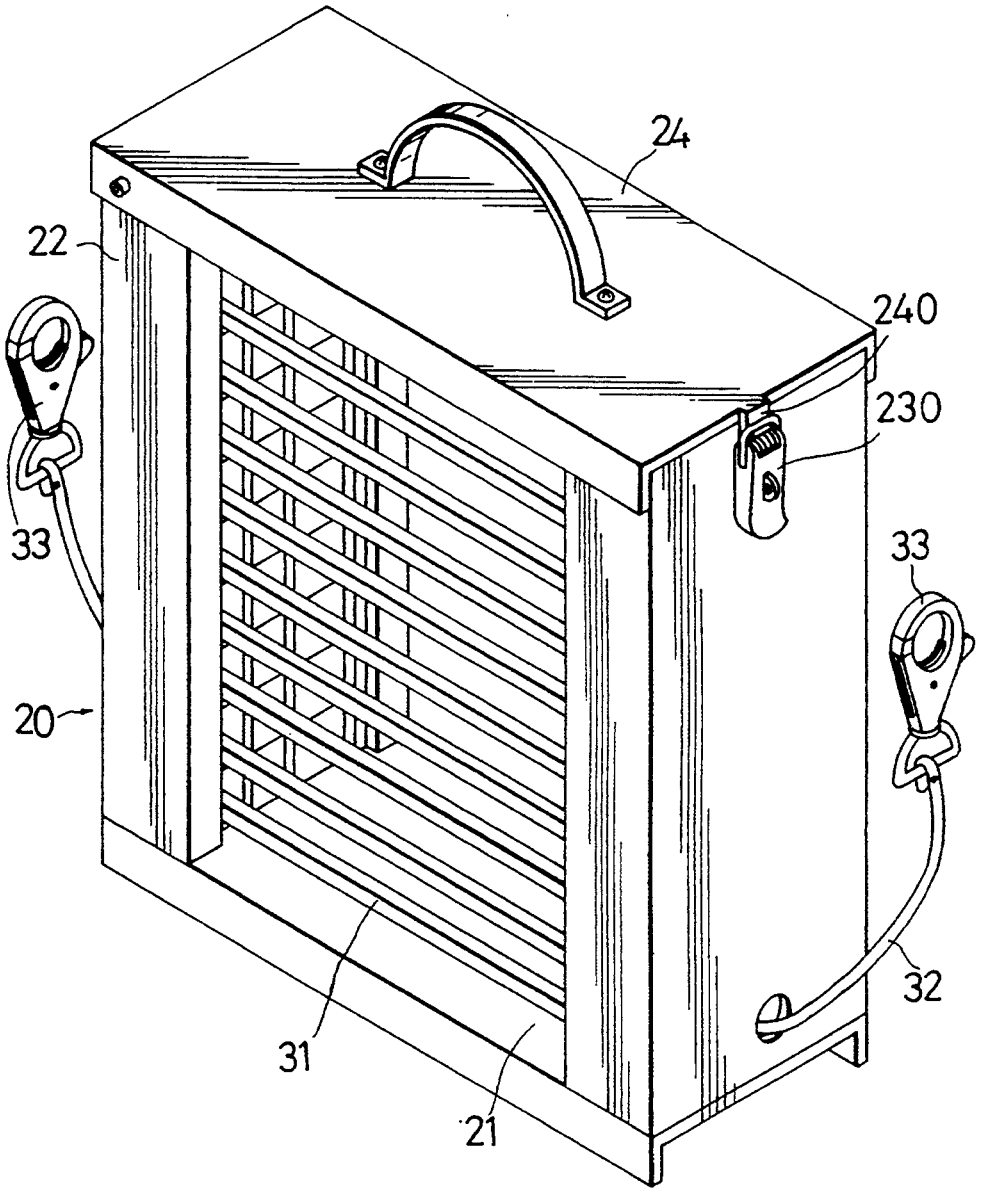
FIG. 10 shows a schematic, perspective view of the second preferred embodiment of the emergency escape device of the present invention.

In order for the emergency escape device of the present invention to be used at a desired place, the device is produced in a portable type, as shown in FIG. 10. As best illustrated in FIG. 9, the device includes a rope-ladder carrier 20 and a rope-ladder 30 which is retained and stored therein. The carrier 20 includes an upper horizontal beam 24, a lower horizontal beam 21 and two vertical side beams 23. Each of the vertical side beams 23 has front and rear longitudinal sides. The retaining member in this preferred embodiment includes two L-shaped flanges 230 fixed to the front and rear longitudinal sides of the vertical side beams 23. Two ends of the lower horizontal beam 21 are connected securely to the vertical side beams 23. A first end of the upper horizontal beam 24 is hinged to an opposite end of the vertical side beams 23, while a second end of the upper beam 24 is fasten to an opposite end of the other one of a fastener 25. The rope-ladder 30 used in this embodiment is generally similar to the previous embodiment except that the two free ends of the parallel cables 32 are provided with safety hooks 33. When the rope-ladder 30 is retained and stored in the carrier 20, two L-shaped flange members cooperatively retain the spacers 310 in a stacked arrangement, as shown in FIG. 10.

In use, the carrier 20 is opened so as to rotate the upper horizontal beam 24 about the hinged end in order to take out the rope-ladder 30. The safety hooks 33 of the rope-ladder 30 are hooked to an appropriate place and the rope-ladder 30 is extended downward. The spacers 310 in the rope-ladder 30 abut against a building wall so that the rungs 310 are spaced apart from the wall to facilitate handling of the parallel cable 32 while an escapee's foot steps on the rungs 31 during a descending motion.

To further facilitate carrying purposes, a handle 40 is attached to the upper horizontal beam 24 of the carrier 20.

While preferred embodiments have been explained and described, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. An emergency escape device, characterized by:

a rope-ladder including a pair of parallel cables and a plurality of spaced rungs connected transversely and securely to said parallel cables to form said rope-ladder, each of said rungs having two identical spacers fixed to two ends thereof; and a rectangular rope-ladder carrier including an upper horizontal beam, a lower horizontal beam spaced from said upper horizontal beam and two vertical side beams connected to two free ends of said upper and lower horizontal beams to define said rectangular carrier for receiving and storing said rope-ladder therein, each of said vertical side beams having a vertically extending retaining member to retain said identical spacers in a stacked arrangement with each of said rungs extending transversely between said vertical side beams and being parallel to said upper and lower horizontal beams when said rope-ladder is stored in said rectangular carrier.

2. The emergency escape device as defined in claim 1, characterized in that each of said vertical side beams has front and rear longitudinal sides, said retaining member being two L-shaped flange members which are respectively and securely connected to said front and rear longitudinal sides and which extend inwardly thereof.

3. The emergency escape device as defined in claim 2, characterized in that said pair of parallel cables have a pair of fastening units connected securely to two free ends thereof.

4. The emergency escape device as defined in claim 3, characterized in that two ends of said lower horizontal beam are connected securely to said vertical side beams, a first end of said upper horizontal beam being hinged to an end of one of said vertical side beams, a second end of said upper horizontal beam being connected detachably to one end of another one of said vertical side beams, a handle being attached securely to said upper horizontal beam, said rope-ladder carrier further including a fastener to fasten said upper horizontal beam and said end in another one of said vertical side beams.

5. The emergency escape device as defined in claim 1, characterized in that each of said vertical side beams includes a vertical main member having two ends fixed to said upper and lower horizontal beams, a front and rear longitudinal side, a vertical first groove formed at said front longitudinal side, and a first elongated L-shaped flange extending inwardly from said rear longitudinal side of said vertical main member, said escape device further including a guide frame which guides said rope-ladder in use and which is connected foldably to said carrier so as to be folded over said carrier when said rope-ladder is stored and retained in said carrier, said guide frame including a first transverse member hinged to said lower horizontal beam, a second transverse member to be fastened releasably to said upper horizontal beams when said guide frame is folded, and two vertical side members which respectively interconnect each of said first and second transverse members, each of said vertical side members having a vertical insert and a second L-shaped flange integrally formed with said vertical insert to define a vertical second groove therebetween, said vertical insert fitting releasably in said vertical first groove of said vertical main member and said second L-shaped flange being disposed opposite to said first L-shaped flange to constitute a vertical space to receive said spacers in a stacked arrangement, said longitudinal slit being formed between said first and second L-shaped flanges, said first and second L-shaped flanges cooperatively forming said retaining member when said guide frame is folded, said rungs of said rope-ladder extending transversely through said longitudinal slit between said vertical side members, said guide frame being unfolded relative to said rectangular carrier to permit said rope-ladder to be suspended from said rectangular carrier, wherein said spacers of said rope-ladder are guided downward by said second vertical groove of said vertical side frames.

6. The emergency escape device as defined in claim 5, characterized in that said pair of parallel cables have a pair of engaging pieces fixed at two free ends thereof.

7. The emergency escape device as defined in claim 6, characterized in that each of said vertical main members further has a vertical engaging groove facing one another to receive a respective one of said engaging pieces therein.

* * * * *